US005584520A

United States Patent [19]

Niemeier

[11] Patent Number: 5,584,520

[45] Date of Patent: Dec. 17, 1996

[54] ERGONOMIC CAN CARRIER

[76] Inventor: Larry W. Niemeier, 2800 Bergdolt Rd., Evansville, Ind. 47711

[21] Appl. No.: 449,703

[22] Filed: May 24, 1995

[51] Int. Cl.[6] ..... B65D 25/28

[52] U.S. Cl. ..... 294/34; 220/759; 294/27.1

[58] Field of Search ..... 294/27.1, 29, 31.1, 294/32–34, 142; 16/114 R; 220/696, 736, 752, 755–757, 759, 762, 764, 769; 248/210, 211, 311.2, 312.1

[56] References Cited

U.S. PATENT DOCUMENTS

| | | | |
|---|---|---|---|
| 2,522,658 | 9/1950 | Williams | 248/211 |
| 2,541,390 | 2/1951 | Weigand | 294/27.1 X |
| 2,912,204 | 11/1959 | Raysinger | 294/142 X |
| 3,024,057 | 3/1962 | Lockwood | 294/34 |
| 3,357,668 | 12/1967 | Carrel | 248/210 |
| 3,414,311 | 12/1968 | Trimboli | 248/210 X |
| 3,814,364 | 6/1974 | Gargaro | 248/210 |
| 4,053,131 | 10/1977 | Francis | 294/142 X |
| 4,993,767 | 2/1991 | Song | 294/31.1 |
| 5,482,339 | 1/1996 | Chishko | 294/32 X |

FOREIGN PATENT DOCUMENTS

| | | | |
|---|---|---|---|
| 919593 | 5/1947 | France | 294/27.1 |
| 711169 | 6/1954 | United Kingdom | 294/32 |

*Primary Examiner*—Johnny D. Cherry
*Attorney, Agent, or Firm*—Baker & Daniels

[57] ABSTRACT

An ergonomic can carrier for allowing a person to transport and hold a container, such as a can of paint, in a comfortable fashion while simultaneously allowing ready access to the container contents with little likelihood of spillage. The can carrier includes a platform extending from the carrier body upon which the bottom of the container can be placed. A handle catch, which is provided on the body, receives the handle of the paint can and is designed in conjunction with the carrier platform such that retaining of the paint can handle within the catch holds the paint can on the platform. A handle extending from the body is designed to be conveniently gripped by a user to effect lifting of the container mounted to the carrier. In another embodiment, a container is held on the carrier platform by a second support member which is slidable along the carrier body to engage the top of the container and thereby effect a clamping of the container against the platform.

14 Claims, 3 Drawing Sheets

ERGONOMIC CAN CARRIER

BACKGROUND OF THE INVENTION

The present invention pertains to an apparatus employed to facilitate painting-type tasks, and, in particular, to an apparatus for holding a container such as a can of paint during such tasks.

When painting or staining a room or structure, a painter, whether a professional or a do-it-yourselfer, typically has to lug around the room a can which contains the material, such as paint or stain, which is being applied. While in some instances a painter can set the paint can down during painting, in other situations, such as during the task of touching up numerous small areas which are scattered around a room, a painter may desire to hold the can during painting.

To facilitate their transport and holding by a user, conventional paint cans are generally equipped with a semicircular metal wire handle. The handle is pivotally connected at its respective ends to diametrically opposed outside surfaces of the paint can. The pivotal handle connection allows the handle to be pivoted between an upright position arranged above the can lid, and a swung down or storage position arranged against the side of the can.

Manually holding a paint can by its provided handle during painting operations is problematic in a variety of respects. When a paint can is held in a more conventional carrying fashion wherein the handle is oriented in the upright position and supported by the curled fingers of a user, the handle may interfere with the dipping of an applicator or brush into the paint and may contribute to messes being created. Holding the handle in this manner is also fatiguing and uncomfortable for a painter, as the slender, wire handle provides considerable localized stress on a user's curled fingers, especially when the paint can is full.

To provide better access to a manually held paint can, a painter can rotate the handle downward from the upright position to near its storage position, and then curl his/her thumb of one hand over the handle and support the underside of the paint can with the fingers of that hand. However, this can holding technique is also fatiguing and uncomfortable, as over time the handle may press forcefully into the flesh of the painter's thumb.

Thus, it would be desireable to provide an apparatus which allows a person to readily carry a paint can or similar container in a comfortable manner, but which at the same time does not unduly interfere with the accessing of the contents of the can.

SUMMARY OF THE INVENTION

The present invention provides an ergonomic can carrier which allows a person, such as a painter, to lift and hold an open container filled with a spillable material such as paint in a comfortable fashion with little likelihood of spillage. When a paint can is mounted to the carrier, and as a painter easily holds the carrier handle in one hand, a brush or other applicator can be readily dipped through the unlidded top and into the paint. Because the thin wire paint can handle is not used to hold the paint can, user fatigue may be reduced. And, as the wire handle is not extended above the top of the can during use, the wire handle will not interfere with painting and the opportunity for messes is reduced.

In one form thereof, the present invention provides an ergonomic can carrier for use with a paint can of standard design. The can carrier includes a body and a support component, extending in a forward direction from the body, which is arranged to engage and support the bottom of the paint can. The can carrier includes a handle catch for retaining the paint can handle. The handle catch is arranged in cooperating relationship with the support component such that retaining of the paint can handle by the handle catch when the paint can is supported on the support component holds the paint can on the support component. The carrier also includes a carrier handle, associated with the body, that is manually graspable by a user to allow lifting and carrying of the paint can mounted to the carrier with the paint can bottom supported by the support component and with the paint can handle retained within the handle catch.

In another form thereof, the present invention provides an ergonomic paint can carrier for holding a standard paint can in an upright orientation. The ergonomic paint can carrier includes a carrier body, platform means connected to the carrier body for supporting the paint can, means for holding the paint can handle when the paint can is mounted on the platform means, wherein the handle holding means are arranged in cooperating relationship with the platform means such that the handle holding means retains the paint can on the platform means, and a handle associated with the carrier body and manually graspable by a user.

In still another form thereof, the present invention provides another apparatus for carrying a container that holds a spillable material and that includes a top opening through which a user may access the spillable material. The apparatus includes a body, a first support component, a second support component, and a handle. The first support component is connected to the body and operationally engages either the top or bottom of the container. The second support component is movably mounted to the body and shiftable between a retracted position and an operational position. When in the operational position, the second support component engages the other of the container top and bottom when the first support component operationally engages one of the container top and bottom to thereby hold the container therebetween. The handle extends from the body and is ergonomically structured and arranged relative to the body to be graspable within a hand of the apparatus user while the container is held in a generally upright orientation between the first and second support components to prevent spillage of the spillable material through the container top opening.

One advantage of the ergonomic can carrier of the present invention is that a user can carry a container of paint around on a job site with minimal hand fatigue or discomfort.

Another advantage of the ergonomic can carrier of the present invention is that it can be readily adapted to accommodate different sized containers.

BRIEF DESCRIPTION OF THE DRAWINGS

The above mentioned and other advantages and objects of this invention, and the manner of attaining them, will become more apparent and the invention itself will be better understood by reference to the following description of embodiments of the invention taken in conjunction with the accompanying drawings, wherein.

Figure 1:
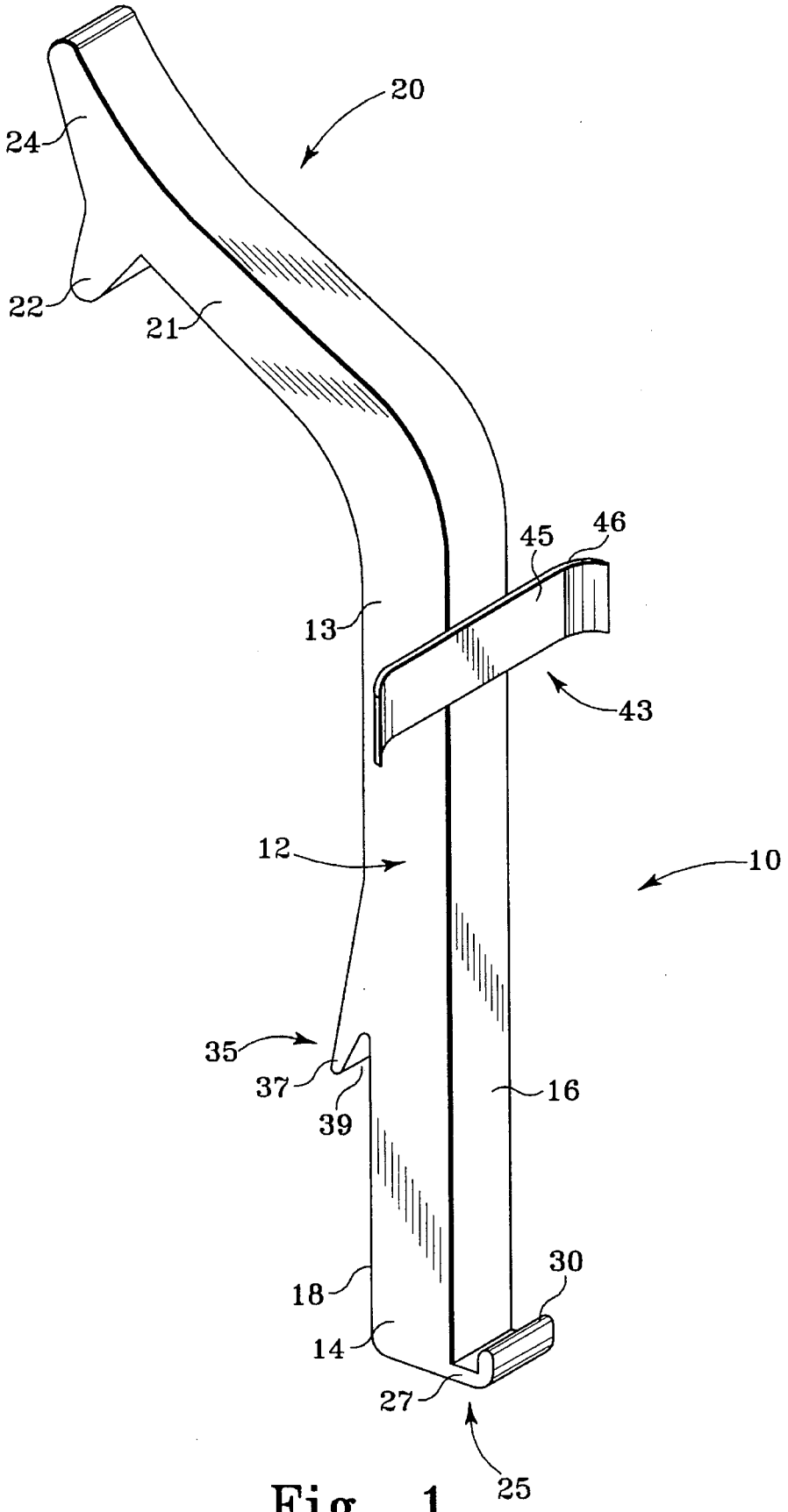
FIG. 1 is a perspective view of one embodiment of a can carrier according to the principles of the present invention.

Corresponding reference characters indicate corresponding parts throughout the several views. Although the drawings represent embodiments of the invention, the drawings are not necessarily to scale and certain features may be exaggerated in order to better illustrate and explain the present invention.

DESCRIPTION OF THE PREFERRED EMBODIMENTS

Figure 2:
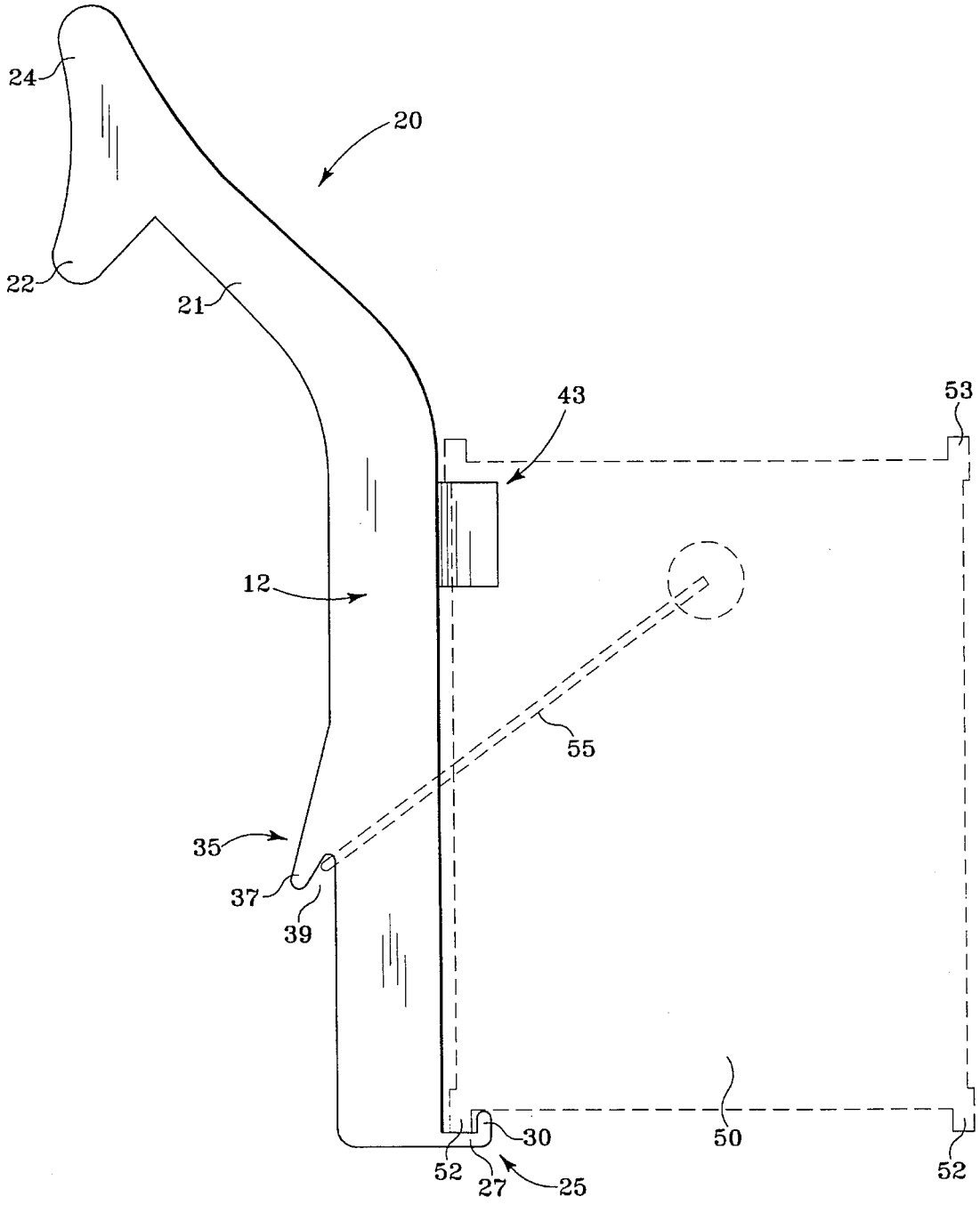
FIG. 2 is a side view of the can carrier of FIG. 1, wherein a paint can operationally mounted to the carrier is shown in dashed lines.

Referring now to FIGS. 1 and 2, there is illustrated in perspective and side views respectively an embodiment of the ergonomic can carrier of the present invention, generally designated 10, which is particularly sized and configured for carrying a gallon size paint can of conventional shape. This type of paint can is shown in dashed lines in FIG. 2 mounted to the carrier 10. The term "paint can" is used in a broad sense herein and is intended to encompass cans for other materials, for example varnishes or stains, that are frequently provided in similarly shaped containers. Moreover, while the instant invention is particularly suited for allowing ready access to the contents of the container being carried, the invention may be employed to merely facilitate the transport or carrying of a paint can from point to point.

The ergonomic can carrier 10 includes a longitudinally elongate body 12 which is generally rectangular in transverse cross-section along a substantial portion of its height. Body 12 may be formed of a variety of rigid materials, such as wood, plastic, or metal, within the scope of the invention. As body 12 merely serves as the base support to which the various can engaging members are mounted, it will be appreciated that a variety of other body shapes and sizes may be substituted within the scope of the invention.

Integrally formed with the top portion 13 of body 12 is a handle or grip, generally designated 20. Handle 20 may alternatively be separately formed and secured to body 12. Handle 20 includes a grip portion 21 which is graspable within the clenched hand of a user of carrier 10. Although shown being rectangular in cross-section, other cross-sectional shapes of grip section 21, including rounded shapes, which better conform to a user's hand may be provided. Grip section 21 is designed to angle upwardly and rearwardly away from body 12. When a user is grasping grip section 21 and allows his/her arm carrying the paint can to hang naturally at his/her side, this ergonomic angling aids in maintaining the paint can 50 in a generally vertical orientation to lessen the potential for spillage.

At the end of grip section 21, downwardly projecting lobe 22 is provided in the underside of handle 20. Lobe 22 serves to positively locate a user's fingers curled around grip section 21 as well as prevent slippage of carrier 10 from the user's grip. An upper surface of handle 20 at the end of grip section 21 is provided with a gently curved lobe 24. Lobe 24 is designed to abut the heel area of a user's hand to further aid in preventing handle 20 from slipping out from a user's clenched grip. The handle may also be provided with an attachment, such as a strap fitting through a slot formed in the handle, allowing for temporary securement to a belt or a ladder rung whereby the paint can may be suspended when a painter wants to have both hands free.

At the base portion 14 of body 12, forwardly projecting beyond front surface 16 of body 12 is a support component, generally designated 25, adapted to support cylindrical paint can 50 mounted to carrier 10. In the shown embodiment, support component 25 includes a solid, plate-shape ledge 27 which terminates at its forward edge with an upstanding rib 30. The upper face of ledge 27 serves as a platform upon which the underside of the circumferential bottom lip 52 of paint can 50 is directly supported. Rib 30 is spaced from forward surface 16 to provide a recess that accommodates bottom lip 52. Rib 30 engages the inner radial periphery of bottom lip 52 to prevent paint can 50 from inadvertently sliding off of ledge 27 and becoming disengaged from carrier 10.

Although shown integrally formed with body base portion 14, support component 25 could be separately formed and then attached. For example, an L-shaped metal bracket correspondingly configured to ledge 27 and rib 30 could be connected to the underside of body base portion 14 with a fastener such as a screw. When made of this metal bracket, ledge 27 may be somewhat resilient so as to allow it to bend downward slightly from the shown position during the process of paint can mounting and then snap return into the shown position to engage the mounted can. For other constructions, such as the integral construction shown, and depending on the resiliency of the material from which the carrier is formed, ledge 27 may be generally rigid. In addition, differently shaped support components supplying a supportive feature could be substituted within the scope of the invention. For example, although the mounting of a paint can would be more complicated in that the support component might need to be removed or pivoted out of the way during the initial stages of paint can mounting and then returned to a supportive arrangement under the paint can for use, the support component could project farther forward underneath paint can 50 to provide a larger platform area or to directly engage the disc-shaped bottom surface of the paint can. The support component could also be a cylindrical sleeve with an annular ledge along its inner radial periphery at the sleeve bottom, and the paint can could insert in the sleeve and set on the ledge. The support component alternatively could be formed in an inverted, frustoconical shape into which the paint can is inserted, and the cone shaping would allow different size cans to be supported therein.

Provided on the rear surface 18 of body 12 is a handle catch, generally designated 35, into which paint can handle 55 is inserted during mounting and retained during use. In the shown embodiment, handle catch 35 is formed by a downwardly and rearwardly projecting finger 37 which defines a substantially vertical slot region 39 with body rear surface 18. Rather than the integral configuration shown, finger 37 could be separately formed and attached to body 12. Slot region 39 is adapted to receive a central segment of wire handle 55. It is recognized that a range of other handle catch configurations are suitable for use. For example, a slot or groove formed into body 12, as well as hooks or otherwise shaped projecting pieces including nubs which would prevent handle 55 from sliding upward along the body, may be substituted within the scope of the invention.

Handle catch 35 and support component 25 are arranged along body 12 in cooperating relationship to effect a securement of a gallon size paint can of standard design. More particularly, as shown in FIG. 2, when paint can 50 is situated in an upright arrangement on ledge 27, handle 55 is retained within slot 39 and not readily removable therefrom unless, for example, paint can 50 is purposefully unseated from ledge 27 by a user. Handle catch 35 prevents paint can 50 from toppling forward off of ledge 27 or sliding upward along body 12 to become spaced from ledge 27, and ledge 27 provides vertical support to paint can 50. It is recognized that handled cans or containers of different size could be accommodated in alternate embodiments. For example, in another embodiment dedicated to a can of a certain size, the handle catch and support component would be positioned in a different cooperating spaced relationship. In still another embodiment adaptable for use with a variety of different sized containers, the positioning along the carrier body of the handle catch and/or the support component relative to one another would be adjustable to account for these different sized containers.

Positioned near the top of body 12 is a centering module, generally designated 43, which may be provided to better prevent paint can 50 from laterally moving or shifting relative to body 12 when mounted. In the shown embodiment, centering module 43 is formed of an arcuate flange 45 shaped to generally conform to the cylindrical exterior of paint can 50. Flange 45 may be formed of a rigid material such as a metal strip and then fastened to body 12, or possibly molded integrally with body 12. The upper edge 46 of flange 45 is positioned to fit beneath the underside of the radially outwardly extending portion of the upper lip 53 of paint can 50. Other centering module configurations may be employed. For example, if front surface 16 were sufficiently wide and concave, paint can 50 could be nested therein to reduce any lateral instability.

The structure of can carrier 10 will be further understood in view of the following explanation of its operation. In order to mount a paint can on carrier 10, the paint can is preferably placed on the ground or a support surface, and the paint can handle 55 is first pivoted downward toward the side of can 50. Then, carrier body 12 is inserted from above between paint can handle 55 and the cylindrical outer surface of paint can 50. Body 12 is maneuvered such that the paint can handle 55 inserts into slot 39 of handle catch 35. As body 12 is forced further downward, thereby simultaneously pulling handle 55 downward such that slot 39 is effectively moved below the paint can handle pivot points, body front surface 16 moves in an arc-shaped path toward paint can 50 such that the space defined within centering module 43 fits around the paint can. As the carrier movement continues, support component 25 comes into abutting contact with the lower region of paint can 50. Due to its construction and pivot mounting, the paint can handle has a limited amount of play or resilience. Consequently, when can 50 is then slightly lifted and effectively moved both upward and toward body 12, the paint can handle gives to allow the bottom lip 52 of can 50 to be forced over support component 25. When the can is finally set on ledge 27, the paint can handle elastically returns to its original arrangement. It will be appreciated that when the metal bracket is used for ledge 27, during this can mounting step, ledge 27 may also bend slightly downward and then snap back into engagement with the can. Tolerances in the location or shape of handle catch 35, as well as in the size and play within paint can handle 55, will affect how tightly the paint can and support component are engaged together.

Paint can 50 is now mounted to carrier 10, and a user may pick up carrier 10 by handle 20 and carry paint can 50 in a convenient fashion to any location where paint is desired. It will be appreciated that a painter can dip a brush into the unlidded can without interference from the paint can handle. Can carrier 10 works best when the paint can is only about three-quarters full or less as the paint can will be slightly angled when mounted in the carrier which is lifted by the carrier handle. This angling is provided such that the dipping motion of the paint brush into the can may occur in a more natural fashion. However, a full paint can may be used if a painter takes care to keep the can level.

Figure 3:
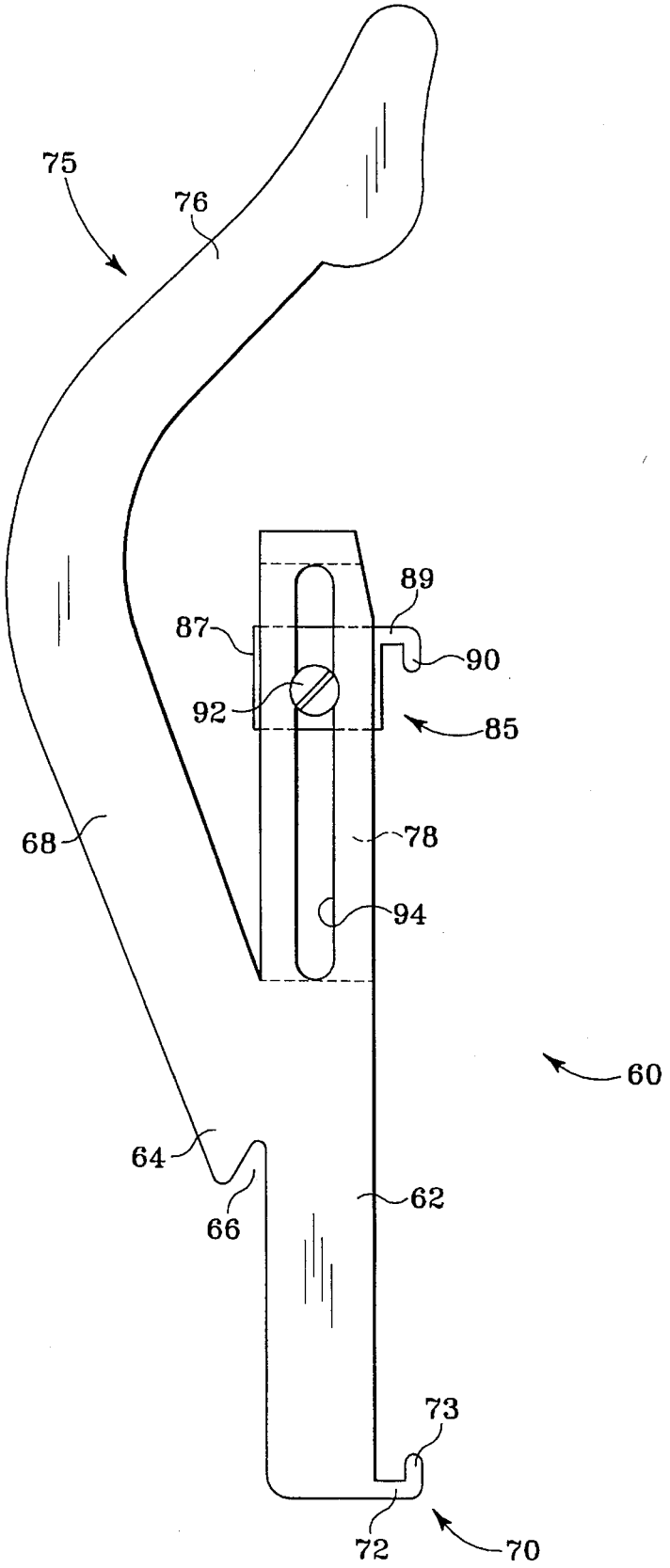
FIG. 3 is a side view of one alternate embodiment of a can carrier of the present invention.

Referring now to FIG. 3, there is shown an alternate embodiment of the can carrier of the present invention which is particularly suited for accommodating different sized containers, such as both a gallon size paint can and a quart size paint can. In this embodiment, can carrier 60 includes a longitudinally elongate body 62 from which projects a fixed, lower support component 70 including ledge 72 and rib 73. A recess 66 in intermediate portion 64 of body 62 serves as a handle catch, and recess 66 and support component 70 are positioned in cooperating relationship to secure a gallon size paint can. A handle, generally designated 75, includes a grip section 76 which upwardly and forwardly extends from a rearwardly and upwardly extending connecting arm 68 of body 62.

Provided in an upper segment of body 62 is cavity 78 in which is disposed an upper support component, generally designated 85. Support component 85 includes a slider body 87 with a forwardly extending clamping finger 89 provided with a locking rib 90. Slider body 87 is slidable up and down within cavity 78. A screw 92 having a shank passing through slot 94 in body 62 and connected to slider body 87 can be tightened against body 62 to secure slider body 87 in a selected vertical position along the height of cavity 78. Other mechanical mechanisms for securing slider body 87 in an operational position, for example a bolt/wing nut assembly through body 62 and slider 87, may alternatively be employed.

In operation, a container, such as a quart size paint can, could be placed on lower support component 70, and then upper support component 85 could be lowered such that clamping finger 89 clamps down on the container to hold the container against ledge 72. Locking rib 90 will fit over the upper lip of a paint can to further secure the paint can to carrier 60. It will be appreciated that while the upper support component is shown being adjustable along the height of body 62 in this embodiment, in other embodiments the lower support component could also or alternatively be so adjustable.

While this invention has been described as having multiple designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An ergonomic can carrier for use with a paint can including a handle, a top with an opening coverable by a lid, and a bottom, the carrier comprising:

a body;

a support component extending in a forward direction from said body, said support component arranged to engage and support the bottom of the paint can;

a handle catch for retaining the paint can handle, wherein said handle catch is arranged in cooperating relationship with said support component such that retaining of the paint can handle by said handle catch when the paint can is supported on said support component holds the paint can on said support component; and a carrier handle associated with said body, said carrier handle manually graspable by a user to allow lifting and carrying of the paint can mounted to said carrier with the paint can bottom supported by said support component and with the paint can handle retained within said handle catch, wherein said handle comprises a grip section and a lobe downwardly projecting from an underside of said handle at a distal end of said grip section, said lobe structured and arranged to positively locate the fingers of a user on said grip section, and wherein said handle further comprises a lobe upwardly projecting from an upper side of said handle at said distal end of said grip section, said upwardly projecting lobe structured and arranged to engage a portion of a hand of the user to prevent slippage of said carrier handle from the hand of the user.

2. The ergonomic can carrier of claim 1 wherein said handle catch is arranged along said body and comprises a rearwardly facing recess for receiving a segment of the length of the paint can handle.

3. The ergonomic can carrier of claim 2 wherein said recess comprises a slot defined by a rearwardly facing surface of said body and an element projecting from said rearwardly facing body surface.

4. The ergonomic can carrier of claim 1 wherein said support component comprises a ledge upon which the paint can bottom is positionable, said support component further comprising an upwardly projecting rib on said ledge, said rib spaced from said body to accommodate a lip of the paint can bottom therebetween, whereby a lateral engagement of the lip by said rib prevents the paint can from sliding forward off the ledge.

5. An ergonomic paint can carrier for holding a paint can in an upright orientation, wherein the paint can includes a lidded top, a bottom, and a handle, the ergonomic paint can carrier comprising:

a carrier body;

platform means connected to said carrier body for supporting the paint can, wherein said platform means projects from a forward surface of said carrier body;

means for holding the paint can handle when the paint can is mounted on said platform means, said handle holding means arranged in cooperating relationship with said platform means such that said handle holding means retains the paint can on said platform means, wherein said handle holding means comprises an upwardly extending slot formed along a rearward surface of said carrier body, said slot positioned at a height along said body such that the paint can handle is rotated downward beyond horizontal for receipt in said slot when the paint can is supported on said platform means; and a handle associated with said carrier body and manually graspable by a user, said handle disposed at a height above said handle holding means slot.

6. An apparatus for carrying a container holding a spillable material, the container including a top and a bottom, wherein the top includes an opening through which a user may access the spillable material, the apparatus comprising;

a body;

a first support component, connected to said body, for operationally engaging one of the container top and bottom, said first support component extending in a forward direction from said body;

wherein said body comprises a portion positioned in a rearward direction from said first support component;

a second support component movably mounted to said body and shiftable between a retracted position and an operational position, wherein said second support component when in said operational position engages the other of the container top and bottom when said first support component operationally engages one of the container top and bottom to thereby hold the container therebetween; and a handle including an inclined grip section extending upwardly and forwardly from said body portion, said handle ergonomically structured and arranged relative to said body to be graspable within a hand of the apparatus user while the container is held in a generally upright orientation between said first and second support components to prevent spillage of the spillable material through the top opening, and wherein said handle and said body portion are cooperatively sized and configured such that said grip section is substantially located in the rearward direction from the container held between said first and second support components to limit interference with accessing the material within the container.

7. The apparatus of claim 6 wherein said first support component engages the container bottom, and wherein said second support component includes a slider body slidably mounted to said body, said second support component further comprising a clamping member projecting from said slider body for engaging the container top.

8. The apparatus of claim 7 wherein said slider body is shiftable within a cavity provided in said body, and wherein the apparatus further comprises means for securing said slider body at a selected location within said body cavity.

9. The apparatus of claim 7 wherein said first support component comprises a ledge, extending from said body, upon which the container bottom is positionable, said first support component further comprising an upwardly projecting rib on said ledge, said rib spaced from said body to accommodate a lip of the container bottom therebetween such that said rib prevents the container from sliding forward off the ledge.

10. The apparatus of claim 9 wherein said second support component further comprises a downwardly projecting rib on said clamping member, said downwardly projecting rib spaced from said slider body to accommodate a lip of the container top therebetween.

11. The apparatus of claim 6 further comprising a handle catch for retaining a handle of the container, said handle catch arranged in cooperating relationship with said first support component to receive and retain the container handle when the container is mounted on said first support component.

12. The apparatus of claim 11 wherein said first support component comprises a ledge extending from a forward surface of said body, and wherein said handle catch is disposed on a rear surface of said body.

13. The apparatus of claim 6 further comprising means for holding a handle of the container when the container bottom is mounted on said first support component such that the container is held on said first support component, wherein said handle holding means comprises an upwardly extending slot formed along a rearward surface of said body, said slot positioned at a height along said body such that the container handle is rotated downward beyond horizontal for receipt in said slot when the container is supported on said first support component.

14. The apparatus of claim 6 wherein said handle comprises a lobe downwardly projecting from an underside of said handle at a distal end of said grip section, said lobe structured and arranged to positively locate the fingers of a user on said grip section, and wherein said handle further comprises a lobe upwardly projecting from an upper side of said handle at said distal end of said grip section, said upwardly projecting lobe structured and arranged to engage a portion of a hand of the user to prevent slippage of said handle from the hand of the user.

* * * * *